US009556559B2

(12) United States Patent
Boeck

(10) Patent No.: US 9,556,559 B2
(45) Date of Patent: Jan. 31, 2017

(54) FORMING WIRE

(71) Applicant: VOITH PATENT GMBH, Heidenheim (DE)

(72) Inventor: Johann Boeck, Fornach (AT)

(73) Assignee: Voith Patent GmbH, Heidenheim (DE)

( * ) Notice: Subject to any disclaimer, the term of this patent is extended or adjusted under 35 U.S.C. 154(b) by 171 days.

(21) Appl. No.: 14/487,309

(22) Filed: Sep. 16, 2014

(65) Prior Publication Data

US 2015/0075743 A1 Mar. 19, 2015

(30) Foreign Application Priority Data

Sep. 16, 2013 (DE) ..... 10 2013 218 465

(51) Int. Cl.

| | |
|---|---|
| ***D21F 1/10*** | (2006.01) |
| ***D03D 13/00*** | (2006.01) |
| ***D21F 1/00*** | (2006.01) |
| *D03D 11/00* | (2006.01) |
| *D03D 3/04* | (2006.01) |

(52) U.S. Cl.

CPC ..... *D21F 1/0045* (2013.01); *D03D 13/004* (2013.01); *D21F 1/0036* (2013.01); *D21F 1/105* (2013.01); *D03D 3/04* (2013.01); *D03D 11/00* (2013.01)

(58) Field of Classification Search

CPC .... D21F 1/0027; D21F 1/0036; D21F 1/0045; D21F 1/0054; D21F 1/10; D21F 1/12; D21F 1/105; D21F 7/08; D21F 7/10; D21F 7/12; D21F 7/083; D03D 3/04; D03D 11/00; D03D 13/00; D03D 13/004; D03D 13/008

USPC ..... 162/348, 358.2, 900–904; 139/383 A, 139/383 AA, 425 A

See application file for complete search history.

(56) References Cited

U.S. PATENT DOCUMENTS

2013/0105030 A1* 5/2013 Heger ..... D03D 5/00 139/383 A

FOREIGN PATENT DOCUMENTS

WO WO 2011/144616 * 11/2011 ..... D21F 1/0045

* cited by examiner

*Primary Examiner* — Eric Hug

(74) *Attorney, Agent, or Firm* — Laurence A. Greenberg; Werner H. Stemer; Ralph E. Locher

(57) ABSTRACT

A fabric tape or forming wire for a fibrous web manufacturing or processing machine, includes an upper fabric layer having upper longitudinal threads and interwoven first crossthreads, and a lower fabric layer having lower longitudinal threads and interwoven lower crossthreads. The fabric layers are stacked and the weaving pattern of the tape repeats. A ratio of upper to lower longitudinal threads in a repeat is smaller than one. The upper and lower longitudinal threads in each repeat are in first and second groups. Each first group is formed by an upper longitudinal thread and two lower longitudinal threads thereunder. Each second group is formed by an upper longitudinal thread and a lower longitudinal thread thereunder. In a perpendicular projection onto the fabric layers, the upper and lower longitudinal threads in each group are not or slightly offset forming a maximum free space of a half upper longitudinal thread diameter therebetween.

20 Claims, 1 Drawing Sheet

FORMING WIRE

CROSS-REFERENCE TO RELATED APPLICATION

This application claims the priority, under 35 U.S.C. §119, of German Patent Application DE 10 2013 218 465.4, filed Sep. 16, 2013; the prior application is herewith incorporated by reference in its entirety.

BACKGROUND OF THE INVENTION

Field of the Invention

The invention relates to a fabric tape, in particular a forming wire, for a machine for manufacturing and/or processing a fibrous web, in particular a paper web, cardboard web or tissue web.

Modern fabric tapes which are employed as a forming wire in a forming section of a paper-making, cardboard-making or tissue-making machine typically have an upper fabric layer which provides a paper side that can be brought into contact with the paper web, and a lower fabric layer which provides a machine side that can be brought into contact with elements of the machine. Different requirements are set in that case for the upper and the lower fabric layers, specifically in terms of the upper fabric layer providing as good a fiber support as possible when forming and dewatering the fibrous web and of the lower fabric layer substantially providing the wear volume and the dimensional stability of the fabric tape.

Fabric tapes which are configured as forming wires in which the ratio of the number of longitudinal threads of the upper fabric layer to the number of longitudinal threads of the lower fabric layer is 1:1 are known from the prior art. Such forming wires have the disadvantage that the use of comparatively thick longitudinal threads of the lower fabric layer, for providing an adequately high dimensional stability of the wire, leads to a rather open upper fabric layer having only slight fiber support. In order to overcome the disadvantages of such wires, in the past wires having a ratio of the number of longitudinal threads of the upper fabric layer to the number of longitudinal threads of the lower fabric layer of more than one have been proposed, such as 2:1, 3:2 or 5:2 for example. As a result thereof it became possible to achieve both satisfactory fiber support by way of the upper fabric layer and also satisfactory dimensional stability by way of the lower fabric layer.

It has proven disadvantageous in the afore-mentioned wires that often an increased tendency toward visible hydraulic markings on the fibrous web produced thereon exists, as does insufficient planarity of the upper fabric layer, since the longitudinal threads of the upper fabric layer (upper longitudinal threads) are only insufficiently supported by the longitudinal threads of the lower fabric layer (lower longitudinal threads). Insufficient planarity may lead to an undesirable accumulation of fibers and filler material in the "depressions" of the upper fabric layer.

In the case of forming wires known from the prior art, those disadvantages are observed as the ratio of the number of upper longitudinal threads to the number of lower longitudinal threads increases.

Furthermore, forming wires in which the upper fabric layer has fewer longitudinal threads (upper longitudinal threads) than the lower fabric layer (lower longitudinal threads) are known from the prior art. In those wires a high number of upper cross threads are provided in order to provide an upper fabric layer which is not too open. In those wires it proves advantageous that, due to the high number of upper cross threads, there is good fiber support of the fibers of the fibrous suspension, which are often largely oriented in the longitudinal direction of the wire, during forming of the fibrous web.

It is considered disadvantageous in the aforementioned wires having fewer upper than lower longitudinal threads per repeat that often insufficient planarity of the upper fabric layer exists, since the longitudinal threads of the upper fabric layer (upper longitudinal threads) are only insufficiently supported by the longitudinal threads of the lower fabric layer (lower longitudinal threads). Insufficient planarity may lead to an undesirable accumulation of fibers and filler material in "depressions" of the upper fabric layer.

SUMMARY OF THE INVENTION

It is accordingly an object of the invention to provide a fabric tape for use as a forming wire in a machine for manufacturing and/or processing a fibrous web, such as, in particular, a paper web, cardboard web or tissue web, which significantly reduces or eliminates the hereinafore-mentioned disadvantages of the heretofore-known devices of this general type.

With the foregoing and other objects in view there is provided, in accordance with the invention, a fabric tape, in particular a forming wire, for a machine for manufacturing and/or processing a fibrous web, comprising an upper fabric layer having upper longitudinal threads and, interwoven therewith, first cross threads, and a lower fabric layer having lower longitudinal threads and, interwoven therewith, lower cross threads, wherein the two fabric layers are disposed on top of one another and the weaving pattern of the fabric tape recurs in repeats, wherein the ratio of upper longitudinal threads to lower longitudinal threads in the repeat is smaller than one, and the upper longitudinal threads and the lower longitudinal threads in each repeat are disposed in a plurality of groups, having at least one first group and at least one second group, wherein each first group is formed by an upper longitudinal thread and, disposed thereunder, two lower longitudinal threads, and each second group is in each case formed by an upper longitudinal thread and, disposed thereunder, one lower longitudinal thread, and wherein, when viewed in a perpendicular projection onto the fabric layers, the upper and lower longitudinal threads in each group are disposed so as to be not offset or only slightly offset in relation to one another in such a way that at maximum a free space of half a diameter of an upper longitudinal thread is formed therebetween.

Other features which are considered as characteristic for the invention are set forth in the appended claims, noting that advantageous embodiments and refinements of the invention are stated in the dependent claims.

Although the invention is illustrated and described herein as embodied in a forming wire, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
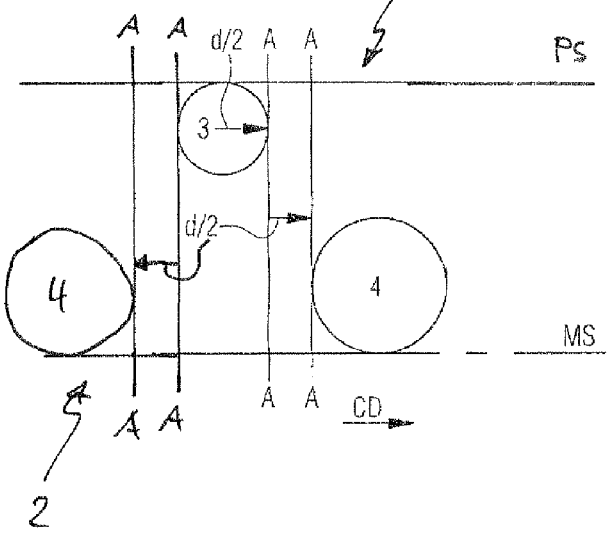
FIGS. 1 and 2 are diagrammatic, cross-sectional views of fabric layers and groups of longitudinal threads.
Figure 2:
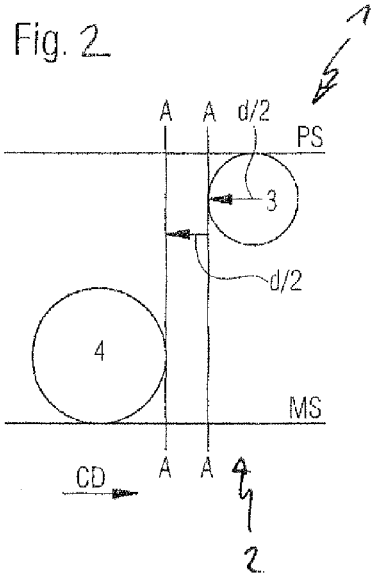

Referring now to the figures of the drawings in detail and first, particularly, to FIG. 1 thereof, there is seen an exemplary embodiment of a first group of longitudinal threads 3, 4 in a sectional plane which runs along a cross-thread direction CD and perpendicularly to fabric layers 1, 2 (upper fabric layer 1, lower fabric layer 2) and/or through planes PS, MS defined thereby. Furthermore, FIG. 2 shows a second group of longitudinal threads 3, 4 in a sectional plane which runs along the cross-thread direction CD and perpendicularly to the fabric layers 1, 2 and/or through the planes PS, MS defined thereby.

It can be seen that the upper and lower longitudinal threads 3, 4 are disposed on top of one another in such a manner that, when viewed in a perpendicular projection onto the fabric layers 1, 2 and/or onto the planes PS, MS defined thereby, as identified by lines A-A, they are disposed so as to be only slightly offset in relation to one another in such a way that at maximum a free space of half a diameter d/2 of an upper longitudinal thread 3 is formed therebetween.

Due to the use of at least one first group and at least one second group per repeat it is ensured according to the present invention that each upper longitudinal thread 3 is sufficiently supported by a lower longitudinal thread 4. As a result thereof, planarity of the upper fabric layer 1 is significantly increased in comparison with the fabric tapes known from the prior art. Since, furthermore, distinctly different dewatering behaviors are caused by way of the first and second groups and at least one first and one second group is disposed in each repeat, a regular and thus easily visible hydraulic marking pattern of the fibrous web manufactured on such a fabric tape is effectively inhibited.

In this case, an upper and a lower longitudinal thread are not to be considered as being offset in relation to one another if the straight line connecting the center point of the cross-sectional area of the upper longitudinal thread and the center point of the cross-sectional area of the lower longitudinal thread runs vertically to a plane defined by the upper fabric layer.

Advantageously, different numbers of first and second groups are provided in each repeat. Since the first and second groups have different dewatering behaviors and thus marking behaviors, it has been demonstrated that due to this measure of different numbers of first and second groups in the repeat an irregularity in the marking pattern can be generated, due to which markings are significantly less visible. This embodiment furthermore offers the possibility of influencing the dewatering behavior of the wire. In the event, for example, that more first groups than second groups are employed, a wire having higher dewatering performance can be achieved than when more second groups than first groups are employed.

It is particularly conceivable in this context that the following applies:

$A=N\times B$; where:

A=number of the first groups in the repeat,
B=number of the second groups in the repeat,
N=integer greater than 1, or $C=M\times D$; where:

C=number of the second groups in the repeat,
D=number of the first groups in the repeat,
M is an integer greater than 1.

Specifically, the number of the first groups in the repeat may be 1 and the number of the second groups in the repeat may be 2, for example. Alternatively, the number of the second groups in the repeat may be 1 and the number of the first groups in the repeat may be 2, for example.

If an unequal number of first and second groups in the repeat is provided it is particularly advantageous for the first and second groups in the repeat to be disposed in a plurality of superordinate groups of longitudinal threads, wherein each superordinate group of longitudinal threads includes at least one first group and at least one second group and, in particular, at least one further group which is selected from the first or second group, and wherein the repeat is formed by an integer number of superordinate groups of longitudinal threads which, in the cross-thread direction, are disposed next to one another. This means that only an integer number of superordinate groups of longitudinal threads are disposed in the repeat and no further other first and/or second group which are/is not a component part of one of the superordinate groups of longitudinal threads are/is present.

Due to the provision of a plurality of superordinate groups of longitudinal threads disposed next to one another in the repeat, a certain degree of regularity in the configuration of the first and second groups is again achieved, due to which a concentration of a plurality of identical groups being disposed immediately next to one another can be avoided.

In this context a superordinate group of longitudinal threads may be formed by one first group and two second groups, for example. It is also conceivable for a superordinate group of longitudinal threads to be formed by two first groups and one second group.

It is conceivable for more first groups than second groups to be provided in the repeat. It is furthermore conceivable for more first groups than second groups to be provided in each superordinate group.

In order to achieve good fiber support of the dewatered fibrous web formed on the fabric tape according to the invention it is preferably provided that the upper fabric layer has an outer side which faces away from the lower fabric layer and which, in the intended use of the fabric tape, provides a paper side which can be brought into contact with the fibrous material. It is furthermore preferably provided that the lower fabric layer has an outer side which faces away from the upper fabric layer and which, in the intended use of the fabric tape, provides a machine side which can be brought into contact with the machine.

In order to further avoid visible hydraulic markings as a result of a regular marking pattern it is furthermore advantageous for at maximum four of the same groups of the first or second group to be disposed immediately next to one another.

Possibly, but not ultimately, the following configurations of the invention are conceivable with respect to the configuration of first and second groups within each superordinate group (note: in the following, a first group is identified in this case using the symbol 1:2 and a second group using the symbol 1:1).

1) Each superordinate group includes the following three first and second groups 1:1-1:2-1:1 and in this case has a ratio of the number of upper longitudinal threads to the number of lower longitudinal threads of 3 to 4.

2) Each superordinate group includes the following five first and second groups 1:2-1:1-1:1-1:1-1:2 and in this case has a ratio of the number of upper longitudinal threads to the number of lower longitudinal threads of 5 to 7.

3) Each superordinate group includes the following seven first and second groups 1:2-1:2-1:2-1:1-1:1-1:1-1:1 and in this case has a ratio of the number of upper longitudinal threads to the number of lower longitudinal threads of 7 to 10.

4) Each superordinate group includes the following three first and second groups 1:1-1:2-1:2 and in this case has a ratio of the number of upper longitudinal threads to the number of lower longitudinal threads of 3 to 5.

5) Each superordinate group includes the following five first and second groups 1:1-1:1-1:2-1:2-1:2 and in this case has a ratio of the number of upper longitudinal threads to the number of lower longitudinal threads of 5 to 8.

6) Each superordinate group includes the following four first and second groups 1:1-1:2-1:2-1:2 and in this case has a ratio of the number of upper longitudinal threads to the number of lower longitudinal threads of 4 to 7.

7) Each superordinate group includes the following two first and second groups 1:1-1:2 and in this case has a ratio of the number of upper longitudinal threads to the number of lower longitudinal threads of 2 to 3.

In the case of all of the above-mentioned examples 1-3 more second groups than first groups are present in each superordinate group. In the case of all of the afore-mentioned examples 4 to 6 fewer second groups than first groups are present in each superordinate group. In example 7, there are exactly as many first as second groups present.

In the case of all illustrated examples the wire has the constructive focus on a high fiber support index (FSI), since in this case more binder threads and/or upper cross threads can be incorporated in the comparatively more open configuration of upper longitudinal threads on the paper side of the upper fabric layer.

The fiber support index according to PCA awards double value to the number of upper cross threads as compared to the upper longitudinal threads. The shape of the openings (pores) formed on the paper side in this case is oriented in a cross-wise manner. The number of pores is equal to the number of fiber-support points. These constructions are aimed at a very regular sheet formation, since the cross-wise oriented pores permit the paper fibers to penetrate the wire to a lesser extent and, as a result thereof, very smooth fibrous-web surfaces can be achieved.

The longitudinal threads of the fabric tape preferably provide only first and second groups. As a result thereof it is achieved that each upper longitudinal thread is supported by a lower longitudinal thread.

In order to achieve further homogenization of the dewatering rates it is preferably provided that, when viewed in the direction along the cross threads, the upper longitudinal threads are disposed offset in relation to the lower longitudinal threads.

The first cross threads preferably include binder threads, wherein the binder threads, for interconnecting the two fabric layers, are interwoven with the upper and with the lower longitudinal threads, and wherein the weaving pattern of the upper fabric layer is at least in part or completely formed by interweaving the binder threads with the upper longitudinal threads.

The binder threads may be disposed individually. In order to provide an upper fabric layer having a low tendency toward topographic marking, a further preferred embodiment of the invention provides that the binder threads are disposed as a pair of binder threads or as a triplet of binder threads. It is particularly meaningful in this context for the binder threads of the respective pair of binder threads or triplet of binder threads to be interwoven in a mutually interchanging manner with upper and lower longitudinal threads and, when changing over from being interwoven with upper longitudinal threads to being interwoven with lower longitudinal threads and vice-versa, to intersect while configuring intersection points.

It should be noted at this point that the longitudinal threads, in the intended use of the fabric tape in a paper-making, cardboard-making or tissue-making machine, extend in the conveying or machine direction of the fabric tape and that the cross threads extend in the machine cross direction.

A plurality of possibilities for forming the two fabric layers is conceivable. According to a first possibility it is conceivable for the upper fabric layer to be formed by interweaving the upper longitudinal threads with the binder threads and for the lower fabric layer to be formed by interweaving the lower longitudinal threads with the lower cross threads.

The ratio of pairs of binder threads or triplets of binder threads to lower cross threads in the repeat in this case is preferably greater than one, in particular greater than or equal to two. It is furthermore of advantage for the ratio of pairs of binder threads and/or triplets of binder threads to lower cross threads in the repeat to not be an integer.

Ratios of 2 to 1, 3:1, 3:2, 5:3, 7:4, 8:5 or 5:2 are conceivable, for example.

As an alternative thereto it is conceivable for the first cross threads, in addition to the binder threads, to even include upper cross threads, wherein the upper fabric layer is formed by interweaving the upper longitudinal threads with the upper cross threads and the binder threads, and the lower fabric layer is formed by interweaving the lower longitudinal threads with the lower cross threads. This means that the binder threads are an integral component part of the upper fabric layer and do not at all contribute toward forming the lower fabric layer but merely connect the latter to the upper fabric layer.

In this context, the ratio of upper cross threads and pairs of binder threads and/or triplets of binder threads to lower cross threads in the repeat is, in particular, greater than one, in particular greater than or equal to two. Furthermore, the ratio of upper cross threads and pairs of binder threads and/or triplets of binder threads to lower cross threads in the repeat is preferably not an integer.

Ratios of 2 to 1, 3:1, 3:2, 5:3, 7:4, 8:5 or 5:2 are conceivable, for example.

Due to the high ratio of pairs of binder threads or triplets of binder threads to lower cross threads, according to the first alternative, and/or the high ratio of upper cross threads and pairs of binder threads and/or triplets of binder threads to lower cross threads, according to the second alternative, a wire having a high fiber support index (FSI) is provided. Furthermore, the shape of the openings (pores) formed on the paper side is oriented in a cross-wise manner. This construction is aimed at a very regular sheet formation, since the cross-wise oriented pores permit the paper fibers to penetrate the wire to a lesser extent and, as a result thereof, very smooth fibrous-web surfaces can be achieved.

The weaving path generated by interweaving the binder threads of a pair of binder threads or a triplet of binder threads in a mutually interchanging manner with the upper longitudinal threads preferably corresponds to a weaving path formed by interweaving an upper cross thread with the upper longitudinal threads. In this case, reference is made to "integral" binder threads, since the latter continue the weaving pattern formed by interweaving the upper cross threads with the upper longitudinal threads.

Each pair of binder threads in the repeat preferably provides merely two intersection points. Each triplet of binder threads in the repeat preferably provides merely three intersection points. The small number of intersection points per repeat contributes toward a very smooth and planar paper side of the upper fabric layer.

It is furthermore provided that the binder threads of each pair of binder threads or triplet of binder threads, between immediately successive intersection points, form in each case first binder segments by interweaving with the upper longitudinal threads, wherein at least one of the first binder segments of each pair of binder threads or triplet of binder threads in the repeat is formed in that the respective binder thread, running on the outer side of the upper fabric layer, intersects at least two, preferably at least three—such as, for example, four—not immediately successive upper longitudinal threads. The long length of the first binder segments likewise contributes toward a very smooth and planar paper side of the upper fabric layer, as does the only small number of intersection points per repeat.

Such fabric tapes are preferably manufactured by using high shaft-number technology in which one repeat of the fabric tape includes 26 or more longitudinal threads.

According to a further preferred embodiment of the invention it is provided that the binder threads, when changing over from being interwoven with the upper longitudinal threads to being interwoven with the lower longitudinal threads and vice-versa, running between the two fabric layers, intersect at minimum four immediately adjoining, preferably at maximum three immediately adjoining lower longitudinal threads. Due to the comparatively short inner float length of the binder threads between the two fabric layers a good balance is achieved between small thickness of the fabric tape according to the invention, on one hand, and decoupling of the supporting binder points and covering binder points of the binder threads when interconnecting the two fabric layers by way of the binder threads.

If the binder threads are disposed in pairs of binder threads, the binder threads of each pair of binder threads in the repeat together preferably form two first binder segments, wherein the one first binder segment is formed in that the one binder thread of the pair, when being interwoven with the upper longitudinal threads, alternatingly runs on the outer side of the upper fabric layer and between the upper and lower fabric layers and, running on the outer side of the upper fabric layer, intersects at least two upper longitudinal threads, and wherein the other first binder segment is formed in that the other binder thread of the pair, when being interwoven with the upper longitudinal threads, alternatingly runs on the outer side of the upper fabric layer and between the upper and lower fabric layers and, running on the outer side of the upper fabric layer, intersects the same number of upper longitudinal threads as the one binder thread, or up to four, in particular up to two fewer or more upper longitudinal threads than the one binder thread. Also due to the comparatively great length of the two first binder segments which, moreover, are of the same or almost the same length, the planarity of the upper fabric layer is significantly increased, since, as a result thereof, few intersection points of the mutually interchanging binder threads are created.

If the binder threads are disposed in triplets of binder threads, the binder threads of each triplet of binder threads in the repeat together preferably form three first binder segments, wherein the first first binder segment is formed in that the first binder thread of the triplet, when being interwoven with the upper longitudinal threads, alternatingly runs on the outer side of the upper fabric layer and between the upper and lower fabric layers and, running on the outer side of the upper fabric layer, intersects at least two upper longitudinal threads, and wherein the second first binder segment is formed in that the second binder thread of the triplet, when being interwoven with the upper longitudinal threads, alternatingly runs on the outer side of the upper fabric layer and between the upper and lower fabric layers and, running on the outer side of the upper fabric layer, intersects the same number of upper longitudinal threads as the first binder thread, or up to four, in particular up to two fewer or more upper longitudinal threads than the first binder thread, and wherein the third first binder segment is formed in that the third binder thread of the triplet, when being interwoven with the upper longitudinal threads, alternatingly runs on the outer side of the upper fabric layer and between the upper and lower fabric layers and, running on the outer side of the upper fabric layer, intersects the same number of upper longitudinal threads as the first binder thread, or up to four, in particular up to two fewer or more upper longitudinal threads than the first binder thread. Also due to the comparatively great length of the three first binder segments which, moreover, are of the same or almost the same length, the planarity of the upper fabric layer is significantly increased, since, as a result thereof, few intersection points of the mutually interchanging binder threads are created.

According to a further particularly preferred embodiment of the invention it is particularly conceivable for the upper cross threads, the pairs of binder threads or the triplets of binder threads and the lower cross threads to be disposed in first, second, third and fourth cross-thread groups, wherein:

a first cross-thread group is formed by one upper and one lower cross thread and one pair of binder threads or triplet of binder threads, a second cross-thread group is formed by two upper cross threads and two lower cross threads and one pair of binder threads or triplet of binder threads, a third cross-thread group is formed by one upper cross thread and two lower cross threads and one pair of binder threads or triplet of binder threads, and a fourth cross-thread group is formed by two upper cross threads and one lower cross thread and one pair of binder threads or triplet of binder threads.

The afore-mentioned refinement may also represent an invention which is independent of the present invention and may be the subject matter of a separate patent application.

In this context it is particularly conceivable for the cross threads and binder threads in the repeat to be disposed in a plurality of superordinate groups of cross threads, wherein one superordinate group of cross threads is formed by at least two cross-thread groups selected from the first, second, third or fourth cross-thread group and wherein the repeat is formed by an integer number of superordinate groups of cross threads which are disposed next to one another in the longitudinal-thread direction. This means that only an integer number of the superordinate group of cross threads are disposed in the repeat and no further other first and/or second cross-thread group which is not a component part of one of the superordinate groups of cross threads is present.

In this case, under each upper cross thread one lower cross thread is preferably disposed in such a manner that each upper cross thread is supported by a lower cross thread. As a result thereof cross-wise stability of the fabric tape according to the invention is significantly increased.

When viewed in the direction along the longitudinal threads, at least some of the upper and the lower cross threads are preferably disposed so as to be offset in relation to one another. In this case, an upper and a lower cross thread are not to be considered as being offset in relation to one another if the straight line connecting the center point of the cross-sectional area of the upper cross thread and the center point of the cross-sectional area of the lower cross thread runs vertically to a plane defined by the upper fabric layer.

According to a preferred embodiment of the invention the weaving pattern of the upper fabric layer forms a plain weave.

According to a further preferred embodiment of the invention it is conceivable for the lower fabric layer to be a regular or irregular satin weave, in particular a satin weave having a pitch number of 3 and/or a progression number of 3. Specifically, such satin weaves may be, for example, satin weaves of the lower fabric layer, having 5 or 7 or 8 lower longitudinal threads per repeat. A satin weave of the lower fabric layer, having 6 lower longitudinal threads per repeat is not preferred in this case since in the case of this in combination with the ratio of upper longitudinal threads to lower longitudinal threads per repeat being smaller than one, according to the invention, an undesirable grouping of in each case three adjoining lower longitudinal threads is created, leading to undesirable high variation in the dewatering behavior and to hydraulic markings connected therewith.

The diameter of the lower longitudinal threads is preferably in the range of 0.15 mm to 0.45 mm, wherein particularly the upper longitudinal threads have a diameter of 30% to 60%, preferably 38% to 53% of the diameter of the lower longitudinal threads. As a result thereof a fabric tape having a particularly fine upper fabric layer and a lower fabric layer which is nevertheless sufficiently stable in order to provide a high wear volume and/or high dimensional stability may be created.

In order to achieve a particularly fine paper side which offers high fiber support it is, in particular, conceivable for the upper longitudinal threads to have a diameter of 0.1 mm or less.

In order to obtain as regular an upper fabric layer as possible it is particularly meaningful for the upper cross threads and/or the binder threads to have a diameter of 80% to 120% of the diameter of the upper longitudinal threads.

In the case of the fabric tape according to the invention being a so-called "weft runner," that is to say a fabric tape in which the machine side is substantially provided by the abrasion volume of the lower cross threads, it is particularly meaningful for the lower cross threads to have a diameter of 100% to 200% of the diameter of the lower longitudinal threads.

In the event that the threads do not have a circular cross-sectional area, the term diameter is intended to mean the diameter of a circular cross-sectional area which has the same surface area as the cross-sectional area which does not have a circular cross section.

The upper fabric layer of the fabric tape of the invention, according to a further preferred embodiment of the invention, preferably has a fiber support index (FSI) of 260 to 300, calculated according to the publication "Approved Standard Measuring Method" of the Papermachine Clothing Association (PCA), 19 Rue de la République, 45000 Orléans, France, dated June 2004. As a result thereof it is possible to ensure very good fiber support and retention.

In order to achieve, on the other hand, a high dewatering performance it is furthermore meaningful for high permeability to be provided despite the above-mentioned high FSI value. According to a further particularly preferred embodiment of the invention it is thus provided that the fabric tape has a permeability in the range of 250 cfm to 450 cfm, preferably 300 cfm to 400 cfm, measured at a differential pressure of 100 to 127 Pa, as set forth in the publication "Approved Standard Measuring Method" of the Papermachine Clothing Association (PCA), 19 Rue de la République, 45000 Orléans, France, dated June 2004.

The invention claimed is:

1. A fabric tape for a machine for manufacturing or processing a fibrous web, the fabric tape comprising:

an upper fabric layer having upper longitudinal threads and first cross threads interwoven with said upper longitudinal threads;

a lower fabric layer having lower longitudinal threads and lower cross threads interwoven with said lower longitudinal threads;

said upper and lower fabric layers being disposed on top of one another and forming a weaving pattern of the fabric tape recurring in repeats;

said upper longitudinal threads and said lower longitudinal threads having a ratio in said repeats being smaller than one, and said upper longitudinal threads and said lower longitudinal threads in each of said repeats being disposed in a plurality of groups including at least one first group and at least one second group;

each first group being formed by an upper longitudinal thread and two lower longitudinal threads disposed under said upper longitudinal thread;

each second group being formed in each case by an upper longitudinal thread and one lower longitudinal thread disposed under said upper longitudinal thread; and said upper and lower longitudinal threads in each group, in a perpendicular projection onto said fabric layers, not being offset or being offset relative to one another up to a maximum forming a free space of at most half a diameter of an upper longitudinal thread therebetween;

said first cross threads including binder threads being interwoven with said upper and with said lower longitudinal threads for interconnecting said upper and lower fabric layers, and said weaving pattern of said upper fabric layer being at least partly formed by interweaving said binder threads with said upper longitudinal threads.

2. The fabric tape according to claim 1, which further comprises different numbers of said first and second groups of longitudinal threads.

3. The fabric tape according to claim 1, wherein said first and second groups in said repeat are disposed in a plurality of superordinate groups of longitudinal threads, each superordinate group of longitudinal threads includes at least one first group and at least one second group and said repeat is formed by an integer number of superordinate groups of longitudinal threads disposed next to one another in a cross-thread direction.

4. The fabric tape according to claim 1, wherein at most four of the same first or second groups of longitudinal threads are disposed immediately next to one another.

5. The fabric tape according to claim 1, wherein said upper fabric layer has an outer side facing away from said lower fabric layer, and said outer side has a paper side configured to be brought into contact with the fibrous web during use of the fabric tape.

6. The fabric tape according to claim 1, wherein said lower fabric layer has an outer side facing away from said upper fabric layer, and said outer side provides a machine side configured to be brought into contact with the machine during use of the fabric tape.

7. The fabric tape according to claim 1, wherein the fabric tape has only first and second groups of longitudinal threads.

8. The fabric tape according to claim 1, wherein said binder threads are disposed individually or as a pair of binder threads or as a triplet of binder threads.

9. The fabric tape according to claim 8, wherein said binder threads of said respective pair of binder threads or triplet of binder threads are interwoven in a mutually interchanging manner with said upper and lower longitudinal threads and, when changing over from being interwoven with upper longitudinal threads to being interwoven with lower longitudinal threads and vice-versa, intersect while configuring intersection points.

10. The fabric tape according to claim 9, wherein each pair of said binder threads or triplet of binder threads in said repeat provides two intersection points.

11. The fabric tape according to claim 9, wherein said binder threads of each pair of binder threads or triplet of binder threads, between immediately successive intersection points, each form first binder segments by interweaving with said upper longitudinal threads, and at least one of said first binder segments of each pair of binder threads or triplet of binder threads in said repeat is formed by said respective binder thread, running on said outer side of said upper fabric layer, intersecting at least four, not immediately successive upper longitudinal threads.

12. The fabric tape according to claim 8, wherein:

said binder threads of each pair of binder threads in said repeat together form two first binder segments;

one of said first binder segments being formed by one binder thread of said pair, when being interwoven with said upper longitudinal threads, alternatingly running on said outer side of said upper fabric layer and between said upper and lower fabric layers and, running on said outer side of said upper fabric layer, intersecting at least two upper longitudinal threads; and the other of said first binder segments being formed by the other binder thread of said pair, when being interwoven with said upper longitudinal threads, alternatingly running on said outer side of said upper fabric layer and between said upper and lower fabric layers and, running on said outer side of said upper fabric layer, intersecting the same number of upper longitudinal threads as said one binder thread, or up to four, or up to two fewer or more upper longitudinal threads than said one binder thread.

13. The fabric tape according to claim 1, wherein:

said first cross threads, in addition to said binder threads, include upper cross threads;

said upper fabric layer is formed by interweaving said upper longitudinal threads with said upper cross threads and said binder threads; and said lower fabric layer is formed by interweaving said lower longitudinal threads with said lower cross threads.

14. The fabric tape according to claim 1, wherein a ratio of said upper cross threads and at least one of said pairs of binder threads or triplets of binder threads to said lower cross threads in said repeat is greater than one.

15. The fabric tape according to claim 1, wherein a ratio of said upper cross threads and at least one of said pairs of binder threads or triplets of binder threads to said lower cross threads in said repeat is greater than or equal to two.

16. The fabric tape according to claim 1, wherein a ratio of said upper cross threads and at least one of said pairs of binder threads or triplets of said binder threads to said lower cross threads in said repeat is not an integer.

17. The fabric tape according to claim 1, wherein said upper fabric layer forms a plain weave.

18. The fabric tape according to claim 1, wherein said lower fabric layer forms a satin weave.

19. The fabric tape according to claim 18, wherein said satin weave has at least one of a pitch number of 3 or a progression number of 3.

20. The fabric tape according to claim 1, wherein the fabric tape is a forming wire.

* * * * *